US007168904B1

(12) United States Patent
Perkins et al.

(10) Patent No.: US 7,168,904 B1
(45) Date of Patent: Jan. 30, 2007

(54) PORTABLE VEHICLE STORAGE PLATFORM

(76) Inventors: James Cameron Perkins, 185 Ashbourne Dr., Noblesville, IN (US) 46060; William Douglas Waugh, 102 Wellington Bluff, Noblesville, IN (US) 46060

( * ) Notice: Subject to any disclaimer, the term of this patent is extended or adjusted under 35 U.S.C. 154(b) by 0 days.

(21) Appl. No.: 11/211,967

(22) Filed: Aug. 26, 2005

(51) Int. Cl.
*E04H 6/00* (2006.01)

(52) U.S. Cl. ..... 414/228; 187/203; 187/272; 254/2 B; 254/7 B

(58) Field of Classification Search ..... 414/228; 187/203, 272; 254/2 B, 7 B
See application file for complete search history.

(56) References Cited

U.S. PATENT DOCUMENTS

| | | | | |
|---|---|---|---|---|
| 1,771,695 | A | 7/1930 | Tompkins | |
| 4,095,677 | A * | 6/1978 | Johannson | 187/272 |
| 4,531,614 | A | 7/1985 | Naegeli | |
| 4,645,181 | A * | 2/1987 | Schapansky | 254/2 B |
| 4,809,814 | A | 3/1989 | St. Germain | |
| 5,015,146 | A | 5/1991 | Barnes et al. | |
| 5,035,562 | A | 7/1991 | Rosen | |
| 5,067,866 | A | 11/1991 | Fusaro et al. | |
| 5,339,926 | A | 8/1994 | McCanse et al. | |
| 5,368,430 | A * | 11/1994 | Lin | 414/228 |
| 5,382,130 | A | 1/1995 | Kempf | |
| 5,489,182 | A | 2/1996 | Habicht | |
| 5,553,990 | A | 9/1996 | Kytola, Sr. | |
| 5,636,705 | A | 6/1997 | St. Germain | |
| 5,702,222 | A | 12/1997 | Rosen | |
| 5,887,680 | A | 3/1999 | Carsen et al. | |
| 5,941,347 | A | 8/1999 | Pfleger et al. | |
| 5,967,734 | A | 10/1999 | Liu | |
| 5,975,495 | A | 11/1999 | Berends et al. | |
| 5,979,878 | A | 11/1999 | Blankenship | |
| 6,241,049 | B1 | 6/2001 | Gooch | |
| 6,345,693 | B1 | 2/2002 | Yeo et al. | |
| 6,345,948 | B1 | 2/2002 | Irish | |
| 6,409,153 | B1 | 6/2002 | Norris | |
| 6,464,207 | B2 | 10/2002 | Creel et al. | |
| 6,505,815 | B1 * | 1/2003 | Dellamore | 254/2 B |
| 6,719,099 | B2 | 4/2004 | Lamb et al. | |

OTHER PUBLICATIONS

U.S. Appl. No. 10/366,456, filed Feb. 13, 2002, Perkins/Waugh.

* cited by examiner

*Primary Examiner*—Khoi H. Tran
(74) *Attorney, Agent, or Firm*—Bingham McHale LLP

(57) ABSTRACT

A storage device for off-floor storage, including a base for emplacement on a floor of a storage area, a substantially vertical support member extending from the base and defining a deployment axis, a platform movably connected to the vertical support member, and a lift actuator operationally connected to the platform. The lift actuator may be energized to move the platform into any one of a plurality of substantially parallel vertical positions oriented generally transversely to the deployment axis. The base is decoupled from the floor.

17 Claims, 15 Drawing Sheets

PORTABLE VEHICLE STORAGE PLATFORM

BACKGROUND OF THE INVENTION

The typical home currently includes either a one- or two-car garage. In newer homes having two-car garages, the trend is for the garage to be proportioned to accommodate exactly two mid-size or even compact cars with little to no room left over for storage. This poses a problem for people with such bulky items as lawn tractors, motorcycles, jet skis and the like that cannot reasonably be stored indoors.

One solution is to build an outdoor storage barn or shed for the garage overflow items. While such a structure solves the problem of protecting the items from the elements, outdoor storage structures have several drawbacks. For example, outdoor storage structures are less secure than garages, and are more prone to break-ins and theft of the items stored therein. Another drawback is that since the storage structures are unconnected to the house, they are not be heated or cooled to the extent that a garage is and thus are less desirable for storage of items sensitive to temperature extremes. Further, many communities have ordinances or regulations that prohibit storage structures, therefore obviating this particular solution to the storage problem.

Another storage solution is the suspension of bulky vehicles from the garage ceiling. While this is a practical solution for lightweight items such as bicycles, it is impractical for heavier items such as lawn tractors and motorcycles.

Still another means for storing heavy and bulky items in a garage is through the use of a lift platform, such as the one discussed in U.S. Pat. No. 6,409,153 to Norris. Norris discloses a hydraulically actuated lifting platform that may be bolted to a garage floor and used to lift vehicles, such as motorcycles, off of the garage floor for storage. While useful, the Norris lift still suffers from the disadvantage of being non-portable, since it must be bolted down to the garage floor. The Norris lift also has the drawback of having a central support column extending upwardly at an angle of between 45 and 75 degrees, such that the Norris lift cannot be positioned flush against a garage wall but must instead extend inwardly into the already tight confines of the garage.

There therefore remains a need for a need for a portable storage mechanism that effectively occupies a minimum amount of viable storage space to effectively increase the storage capacity of a garage or like enclosure. The present invention addresses this need.

SUMMARY OF THE INVENTION

The present invention relates to a storage device for off-floor storage. The device includes a base for emplacement on a floor of a storage area, a substantially vertical support member extending from the base and defining a deployment axis, a platform movably connected to the vertical support member, and a lift actuator operationally connected to the platform. The lift actuator may be energized to move the platform into any one of a plurality of substantially parallel vertical positions oriented generally transversely to the deployment axis. The base is decoupled from the floor such that the device may be readily moved from time to time without the requirement of tools to disconnect it from the surface it rests upon and such that utilization of the device does not require permanent marring of that surface.

One object of the present invention is to provide an improved storage lift apparatus. Related objects and advantages of the present invention will be apparent from the following description.

DESCRIPTION OF THE PREFERRED EMBODIMENTS

Figure 1:
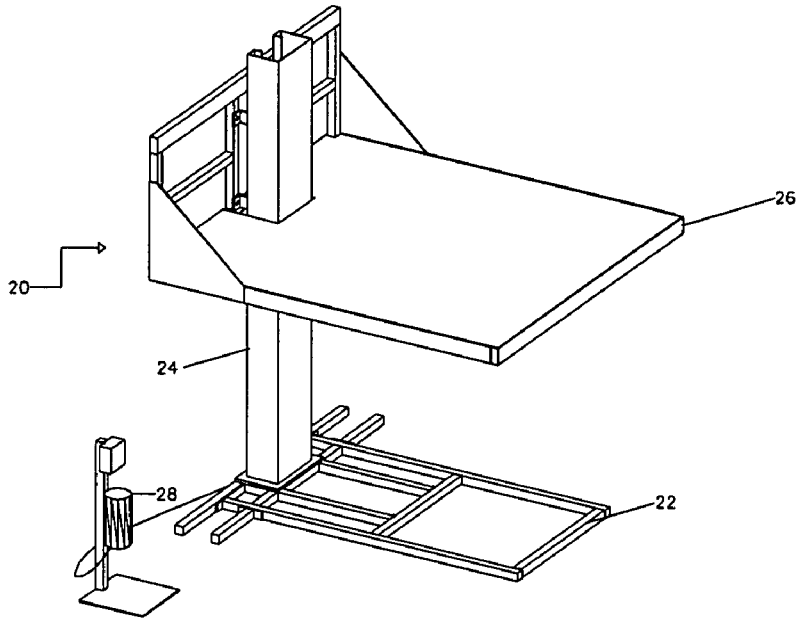
FIG. 1 is a perspective view of a first embodiment portable lifting assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

FIGS. 1–6 illustrate a first embodiment of the present invention, a freestanding or portable elevatable storage platform assembly 20. The platform assembly 20 includes a base portion 22, a support member 24 connected to and upwardly extending from the base portion 22, a platform portion 26 movably connected to the support member 24, and a lift or motion actuator 28 operationally coupled to the platform portion 26 and the support member 24. The support member 24 is preferably rigidly connected to the base portion 22 (such as by fasteners such as bolts or by welding). The support member 24 also preferably extends substantially vertically upwardly from the base portion 22, although the support member 24 may make a slight angle with the base portion 22, with the preferred direction of the angle such that the support member leans slightly to extend over the base portion 22. In other words, while the preferred orientation of the support member 24 is perpendicular to the base portion 22, the support member 24 may deviate slightly from the perpendicular by a few degrees so as to extend away from or (preferably) over the base portion 22.

Figure 7:
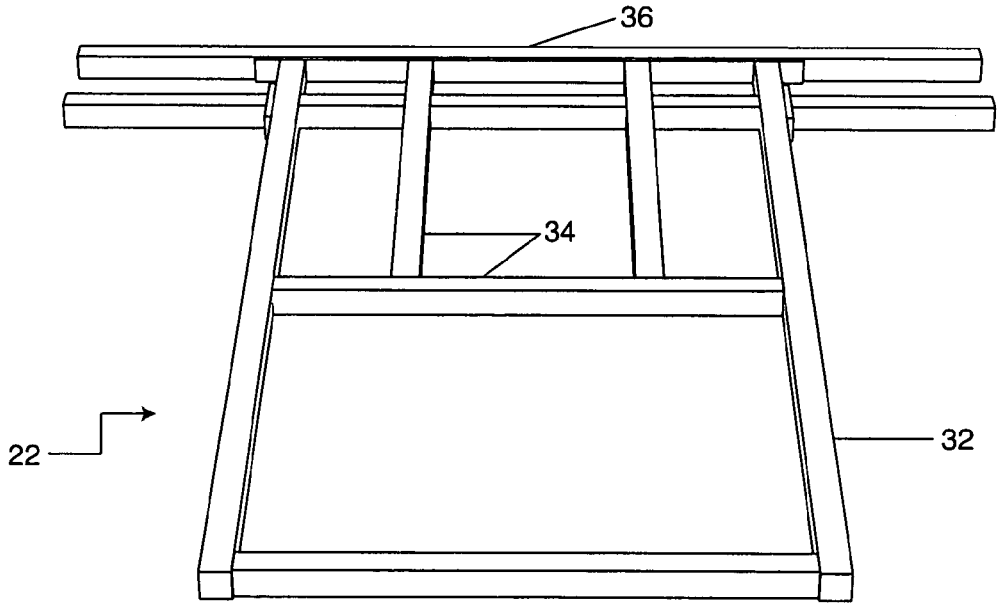
FIG. 7 is a perspective view of the base member of FIG. 1.
Figure 8A:
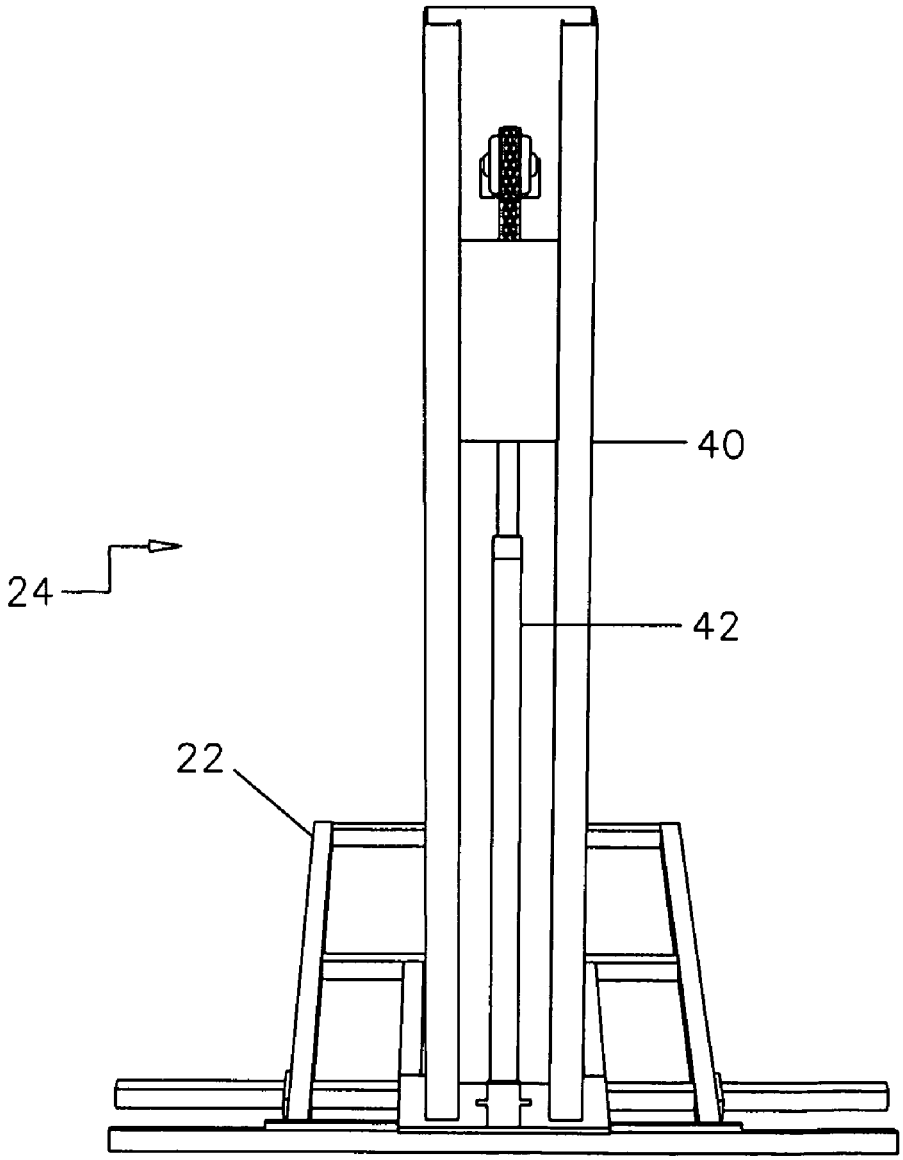
FIG. 8A is a partial rear elevation view of FIG. 1.
Figure 8B:
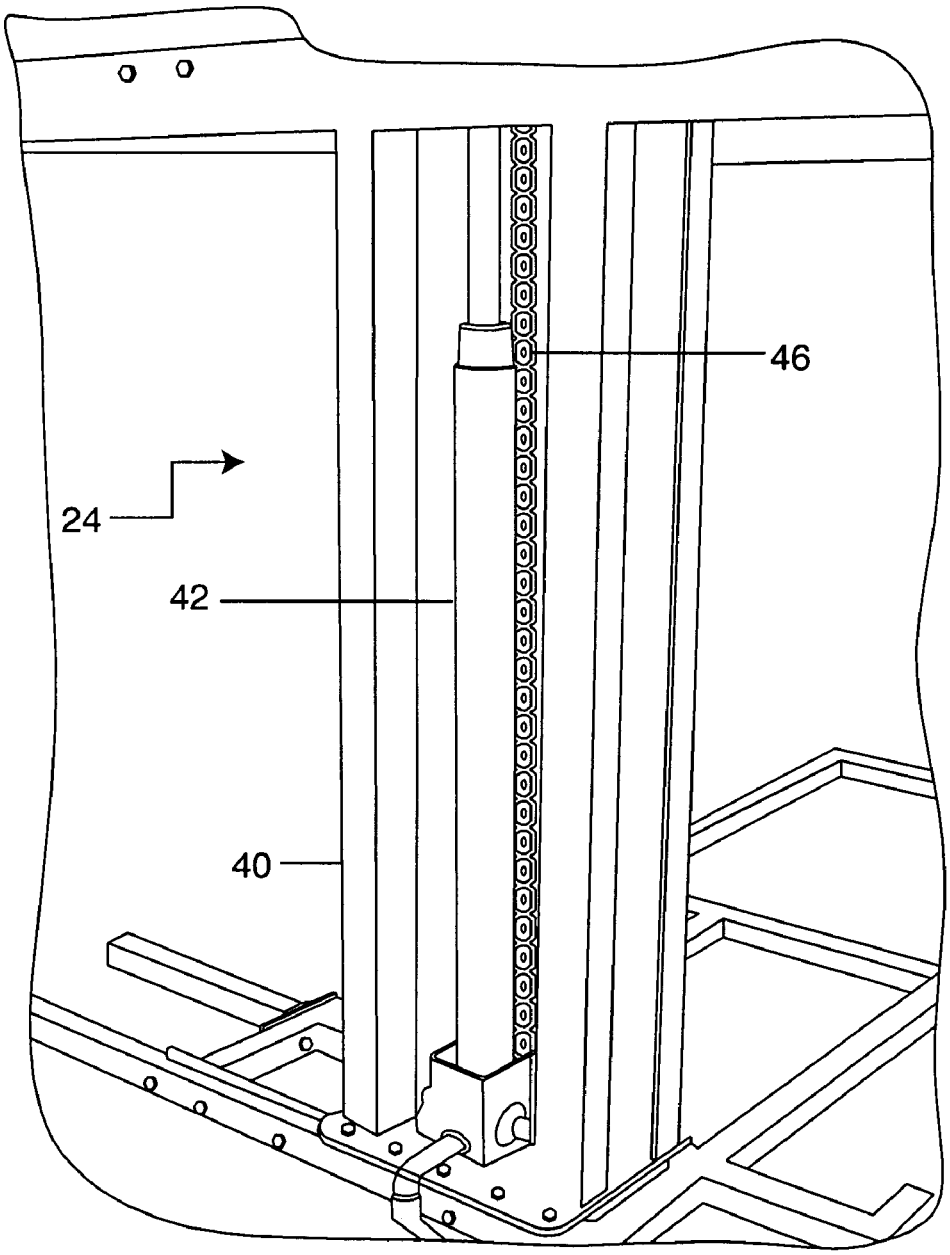
FIG. 8B is a partial rear perspective view of FIG. 1.
Figure 8C:
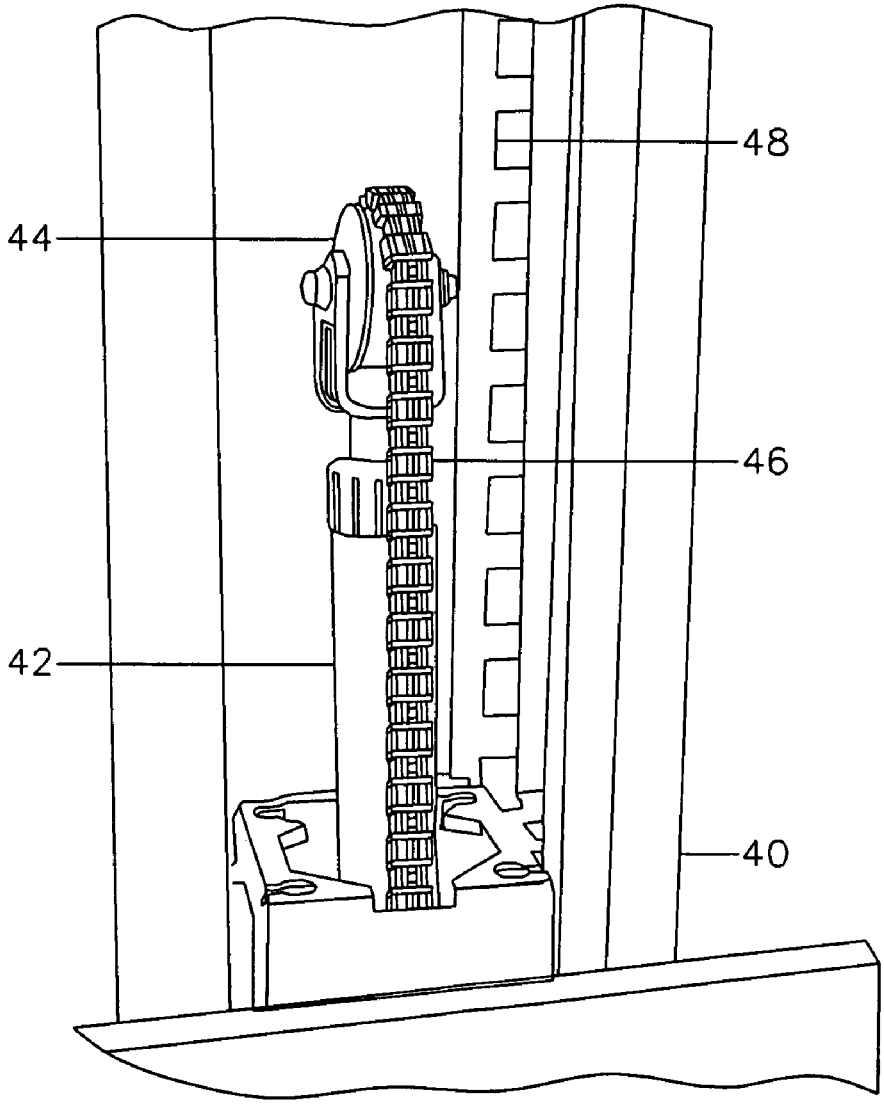
FIG. 8C is a partial rear perspective view of FIG. 8B.

FIG. 7 illustrates the base portion 22 in greater detail. The base portion 22 includes an elongated frame portion 32 that is preferably rectangular in shape, although the frame portion 32 may be of any convenient shape. The base portion 22 also preferably includes supporting cross members 34 connected to and extending at least partially across the frame portion 32. The base portion 22 further includes a support column connecting portion 36 adapted to receive and mechanically connect to the support column 24. In the preferred embodiment, the support column connecting portion 36 is a small framework sized and shaped to snugly receive the support column 24. The support column 24 is preferably connected to the support column connecting portion 36 by mechanical fasteners (such as bolts or screws), or, alternately, by a more permanent means, such as by welding. Preferably, the base portion is made of a structural material, such as steel, aluminum or the like, and more preferably is made from a structural grade steel such as A36 or the like.

The base portion 22 further includes a plurality of leveling feet 37 extending between the base portion 22 and the ground (when the assembly is positioned for use.) The leveling feet 37 are of adjustable length insofar as the length between the base portion 22 and the ground are preferably may be increased or decreased by adjusting the leveling feet 37. The leveling feet 37 are deployed to accommodate for inherent unlevelness of the surface upon which the assembly 20 is desired to be deployed and positioned for use, such as the ground, an unevenly poured and cured garage floor, or the like. It is greatly preferred that the base portion 22 be leveled relative to the horizontal before lifting a load on the platform portion 26 to maximize the stability of the assembly 20. It is also important that any loads placed on the platform portion 26 be distributed as evenly as possible with regard to their mass. Accordingly, it is preferably that the base portion 22 be leveled and also configured to remain in place absent an intentional effort to reposition the assembly 20. In other words, it is preferred that the base portion 22 be non-wheeled and enjoy a friction interface with the ground or supporting surface when the assembly is deployed and positioned for use.

FIGS. 8A–8D show the support member 24 in greater detail. The support member 24 includes an elongated support frame 40 that is preferably characterized by a π-shaped cross-section with one substantially open side. The support member 24 at least partially encloses a lifting member 42. Preferably, as illustrated in this embodiment, lifting member 42 is a hydraulic cylinder. However, in other contemplated embodiments, lifting member 42 may be any convenient mechanical actuator such as a worm drive or the like. A pulley 44 is connected to the upper end of the lifting member 42, and a chain 46 extends from a fixed connection to the base portion 22 or the support member 24, over the pulley 44, and back to the platform portion 26. Extension of the lifting member 42 raises the pulley 44, which puts tension on the chain 46. The chain 46 in turn exerts a lifting force on the platform portion 26, raising it along the support column 26. Lowering the lifting member 42 has the opposite effect of lowering the pulley 44 and lowering the lifting platform 26.

The support member 24 further includes a toothed member 48 positioned therein and oriented parallel with the major axis of the elongated support frame 40.

Figure 9A:
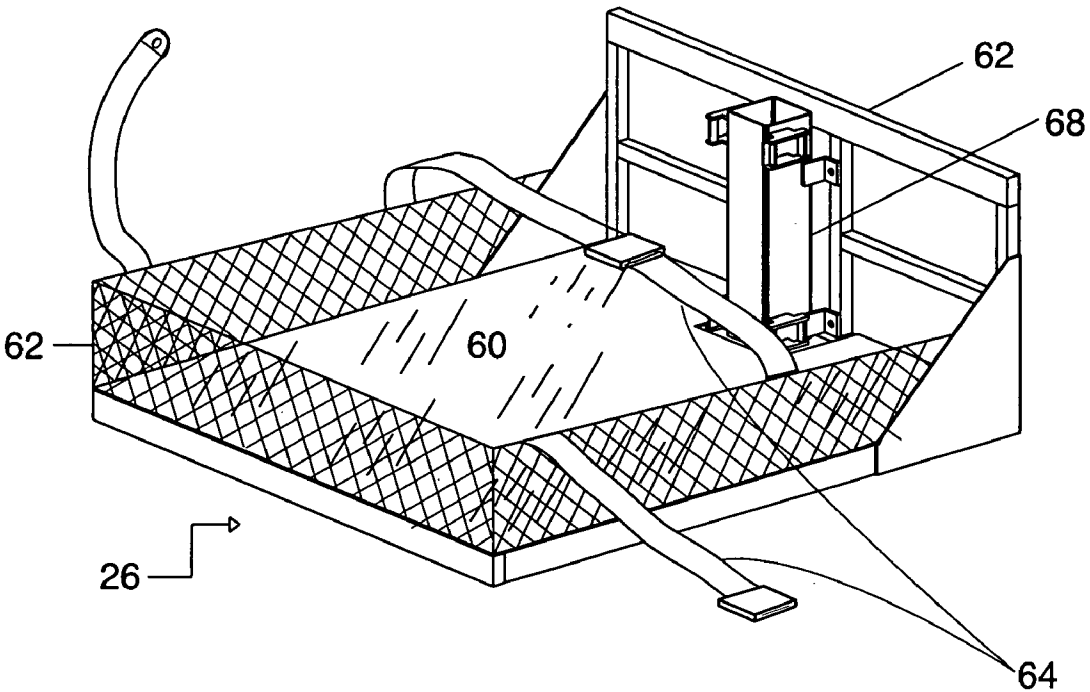
FIG. 9A is a perspective view of the platform of FIG. 1.
Figure 9B:
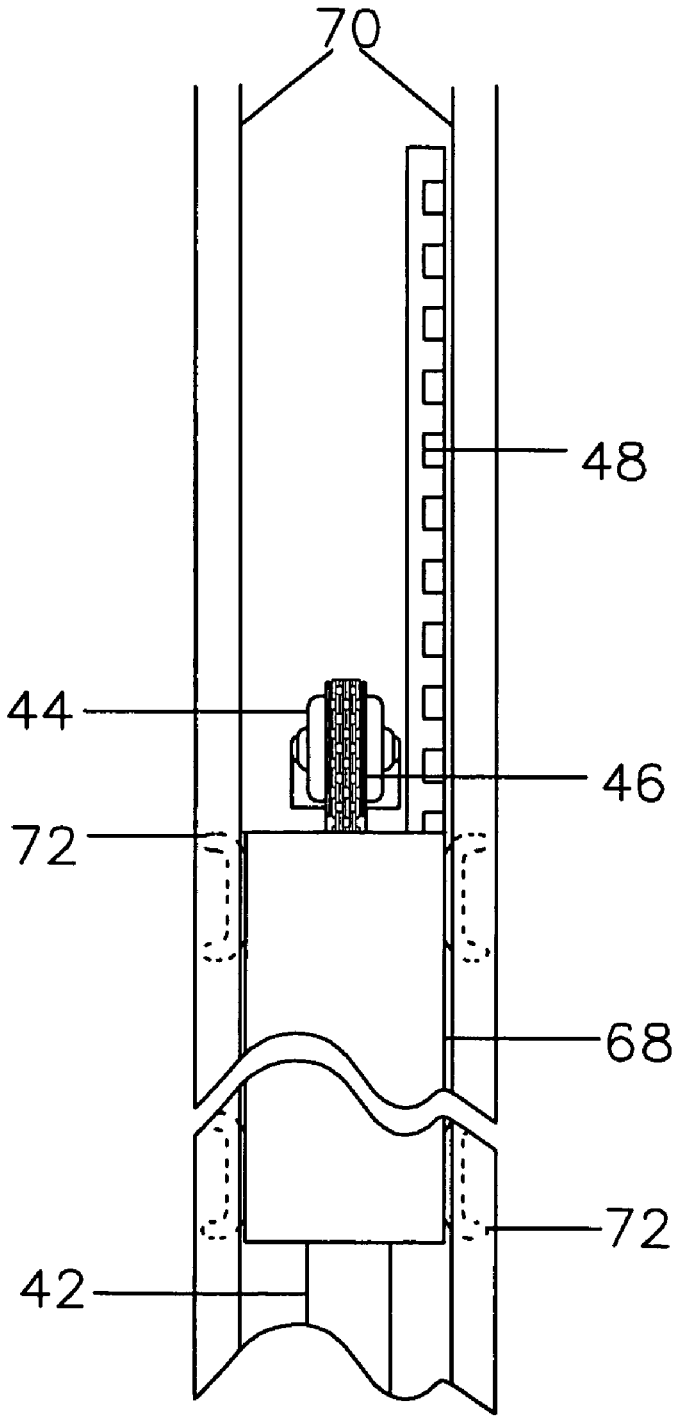
FIG. 9B is a partial rear schematic view of FIG. 1.
Figure 9C:
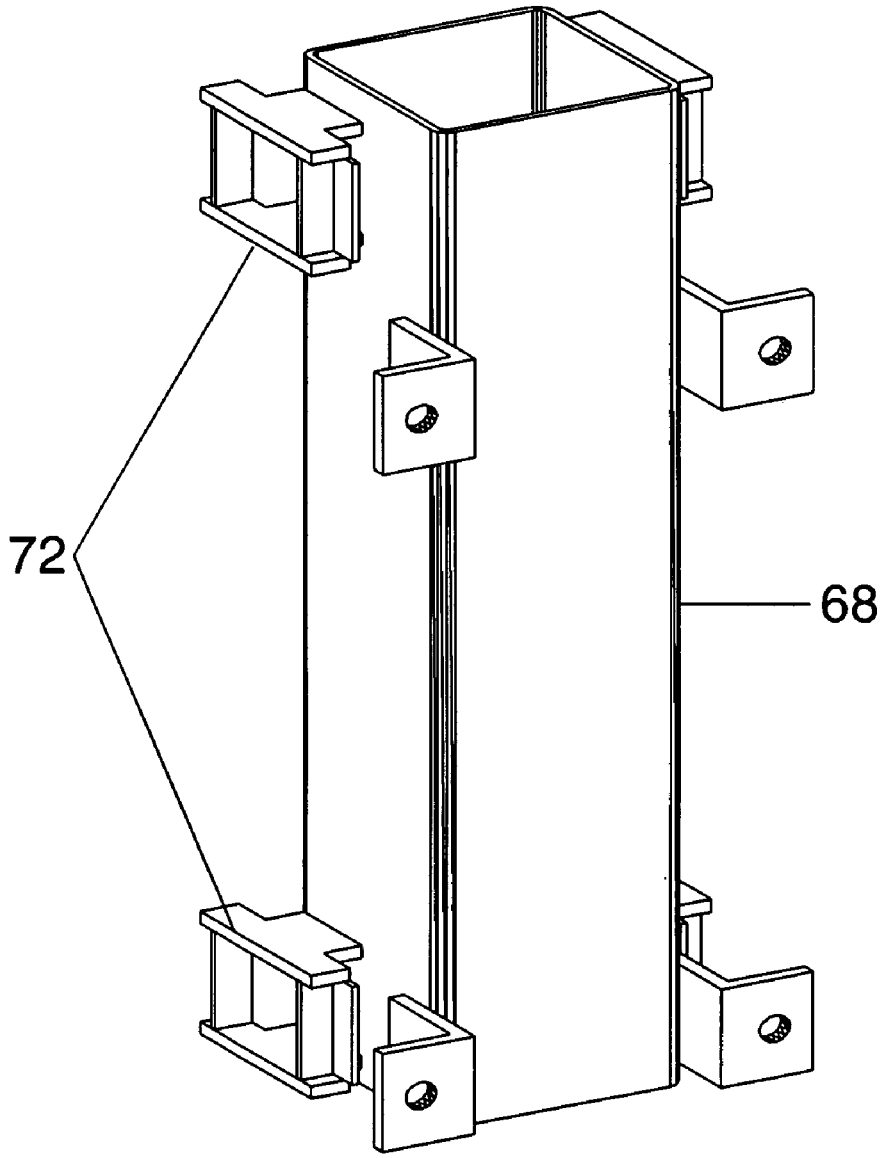
FIG. 9C is a perspective view of a sleeve portion of the embodiment of FIG. 1.

FIGS. 9A–9C illustrate the lifting platform 26 in greater detail. The lifting platform 26 includes an uppermost substantially flat portion 60 upon which the items to be stored or lifting cargo (such as motor cycles, snow blowers, jet skis, lawn tractors, tools, or the like) may be placed. The lifting platform 26 further preferably includes a raised fence portion 62 extending upwardly from the periphery of the flat portion 60 and at least partially enclosing the flat portion 60. Preferably, the fence portion 62 includes flexible members 64, such as nylon straps or elastic cords attached thereto for securing lifting cargo to the lifting platform 26. Preferably, the flat portion 60 is formed from flat structural pieces, such as wooden boards, metal plates, or the like and more preferably are formed from textured 6061 aluminum plating. However, any convenient structural material may be chosen. Even more preferably, the flat portion 60 is substantially solid, but may also be a mesh, a honeycomb, or even a substantially open grid. The fence portion 62 is preferably formed from a structural material, such as aluminum or steel, although any convenient structural material may be selected.

Preferably, the lifting platform portion 26 has an elongated rectangular shape, and more preferably at least partially encloses the lifting member near one end. Even more preferably, the end enclosing the lifting member 24 is opposite the end of the platform portion 26 onto which vehicular cargo, such as motorcycles, will be loaded and unloaded under their own power. Also preferably, the lifting platform portion 26 is positioned over the base portion 22 such that the two portions 22, 26 substantially overlap one another. In other words, when lowered to the ground, the lifting platform portion 26 sits directly on top of and aligned with the base portion 22.

The lifting platform 26 preferably includes a generally rectangular notch 66 formed therein and centrally positioned at the end adjacent the fence portion 62. The notch 66 is sized and shaped to accommodate the support member 24. The platform 26 further preferably includes a sleeve member 68 connected to the fence portion 62 and shaped and sized to slideably fit within the support member 24. More preferably, the support member 24 includes at least one and preferably a pair of parallel rails 70 formed therein and the sleeve member 68 includes at least one and preferably a pair of rail-engaging portions 72 attached thereto and positioned interlockingly slideably engage the rails 70 when the sleeve 68 is disposed within the support member 24.

In one preferred embodiment, the lifting platform 26 includes connection points, such as apertures formed therethrough, to which lightweight storage items may be connected for suspension from the exterior of the platform 26. The items may be either directly connected to the platform 26 or indirectly connected, such as by suspension via a flexible connector.

The dimensions of one preferred embodiment storage platform assembly 20 are as follows. The overall height is preferably less than 9 feet (i.e., the ceiling height of the average garage), and is more preferably in the range of about 8 feet and six inches to about eight feet and eleven inches. The platform portion 26 is substantially rectangular and defined by the measurements of about eighty inches by about eighty-six inches. The base portion 22 is also generally rectangular, having the dimensions seventy-eight inches by forty inches (although the base further includes individual members of lengths in excess of forty inches extending along its otherwise shorter side.) Of course, the assembly 20 may be produced having any convenient dimensions, but is preferably sized to operate in a standard garage and is more preferably sized to provide enough room under a raised and motorcycle-laden platform portion 26 to accommodate the front portion of an automobile parked therebelow.

Figure 2:
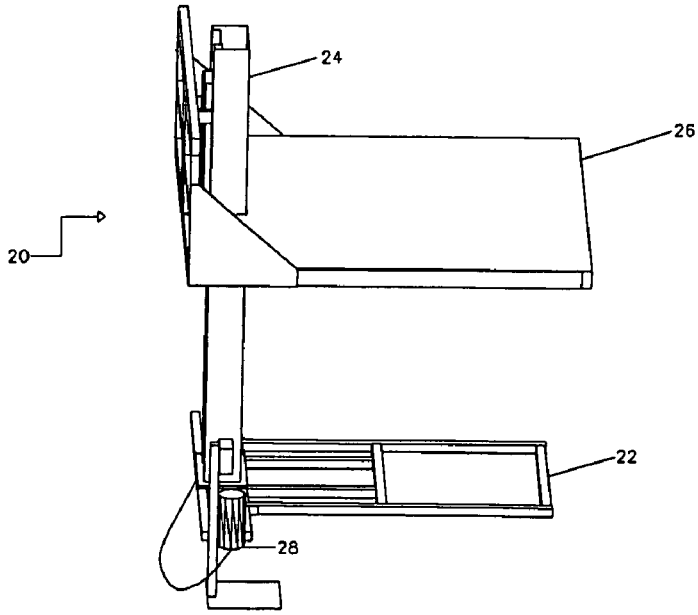
FIG. 2 is a side elevation view of the embodiment of FIG. 1.
Figure 3:
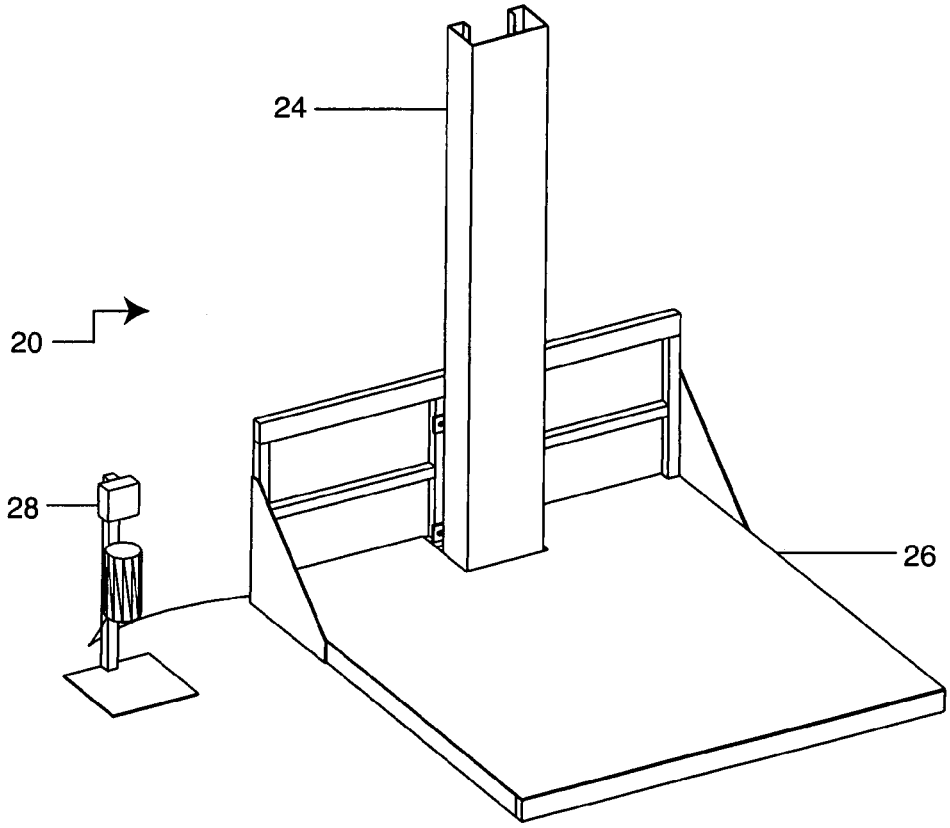
FIG. 3 is a side elevation view of the assembly of FIG. 1 with the platform in a lowered position.
Figure 4:
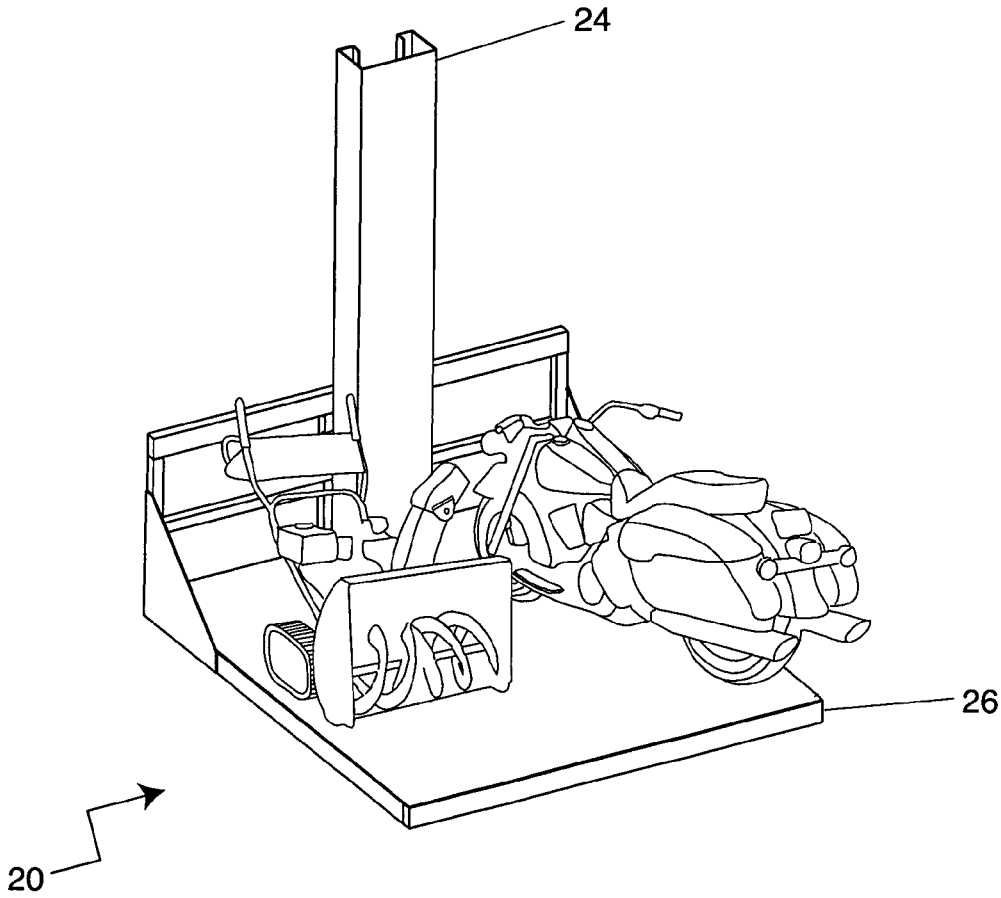
FIG. 4 is a perspective view of the assembly of FIG. 4 loaded with a motorcycle and a lawn tool.
Figure 5:
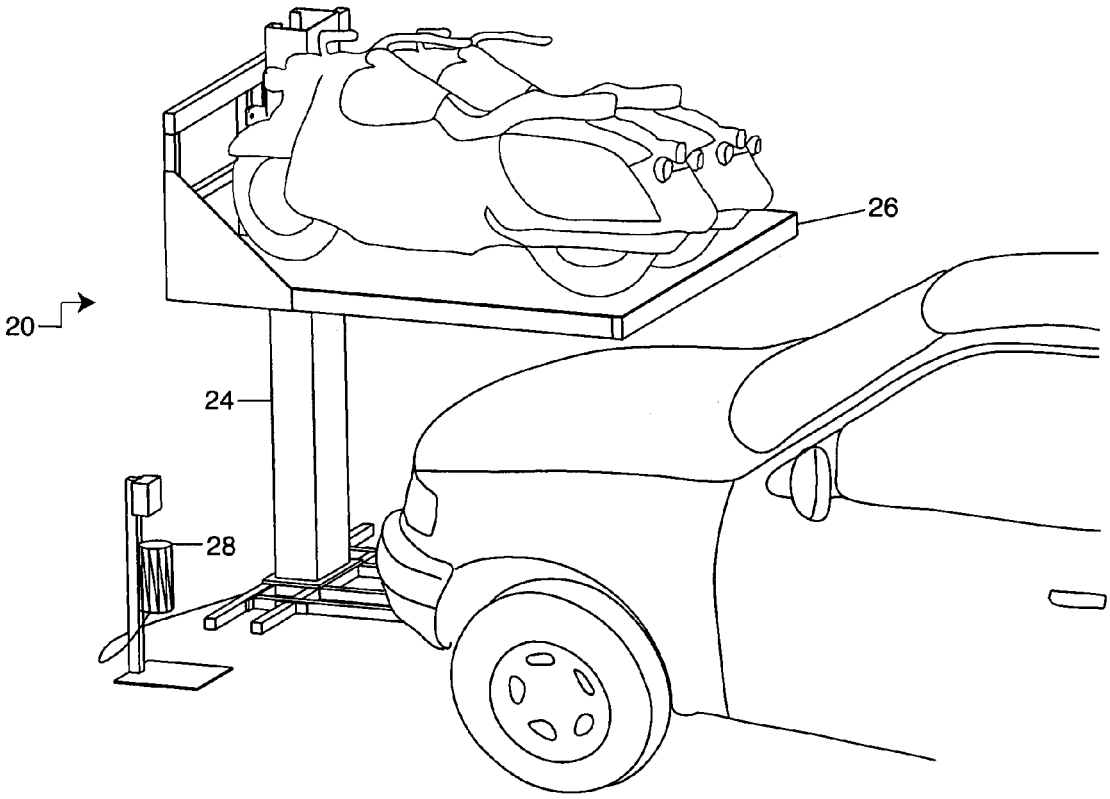
FIG. 5 is a perspective view of the embodiment of FIG. 1 loaded with a pair of motorcycles and having an automobile parked therebelow.
Figure 6:
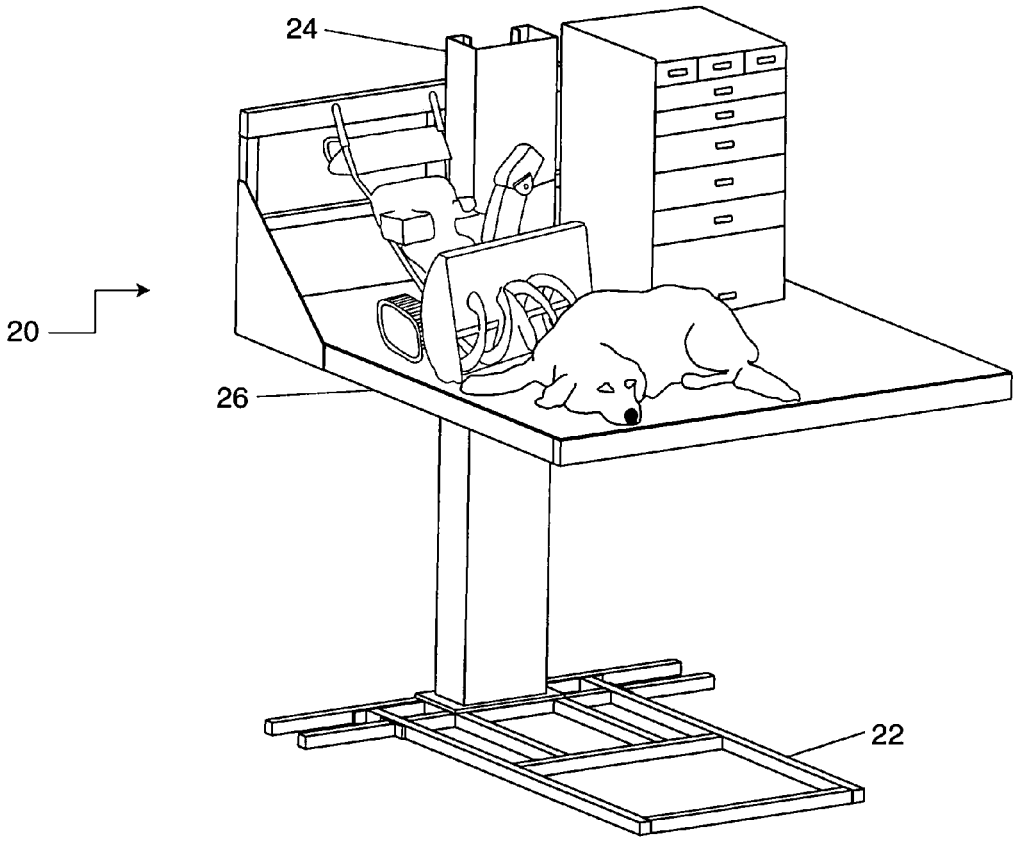
FIG. 6 is a perspective view of the embodiment of FIG. 1 loaded with tools, a lawn mower and a dog.

In operation, the platform portion 26 enjoys a sliding and cantilevered connection to the support column 24, such that the platform portion 26 remains in a substantially perpendicular orientation to the support column 24 as the platform portion 26 is moved along support column 24 (see FIGS. 1–3). In other words, the platform portion 26 remains substantially horizontal as it is raised and lowered.

Figure 10:
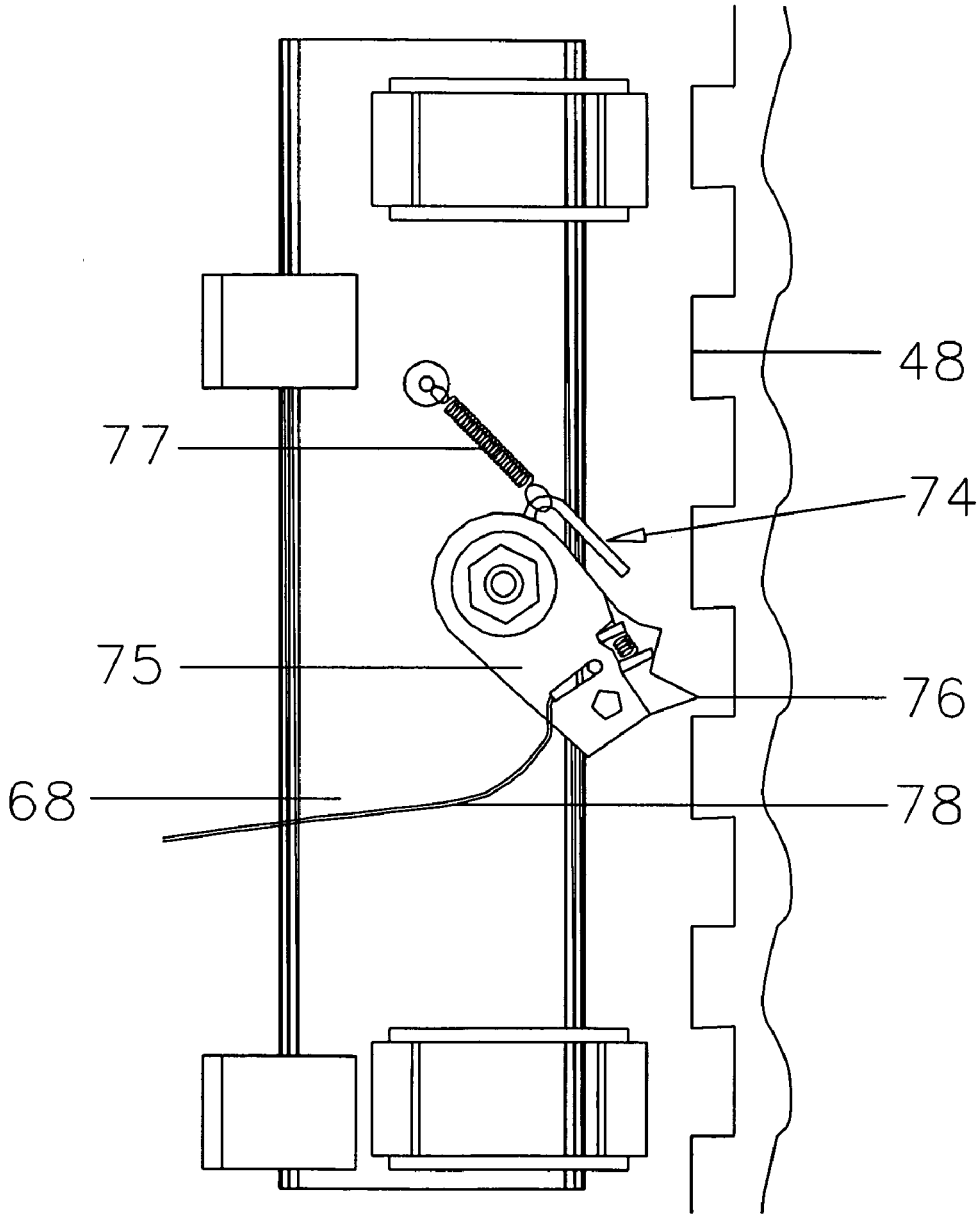
FIG. 10 is a schematic view of the safety latch of the embodiment of FIG. 1.
Figure 12:
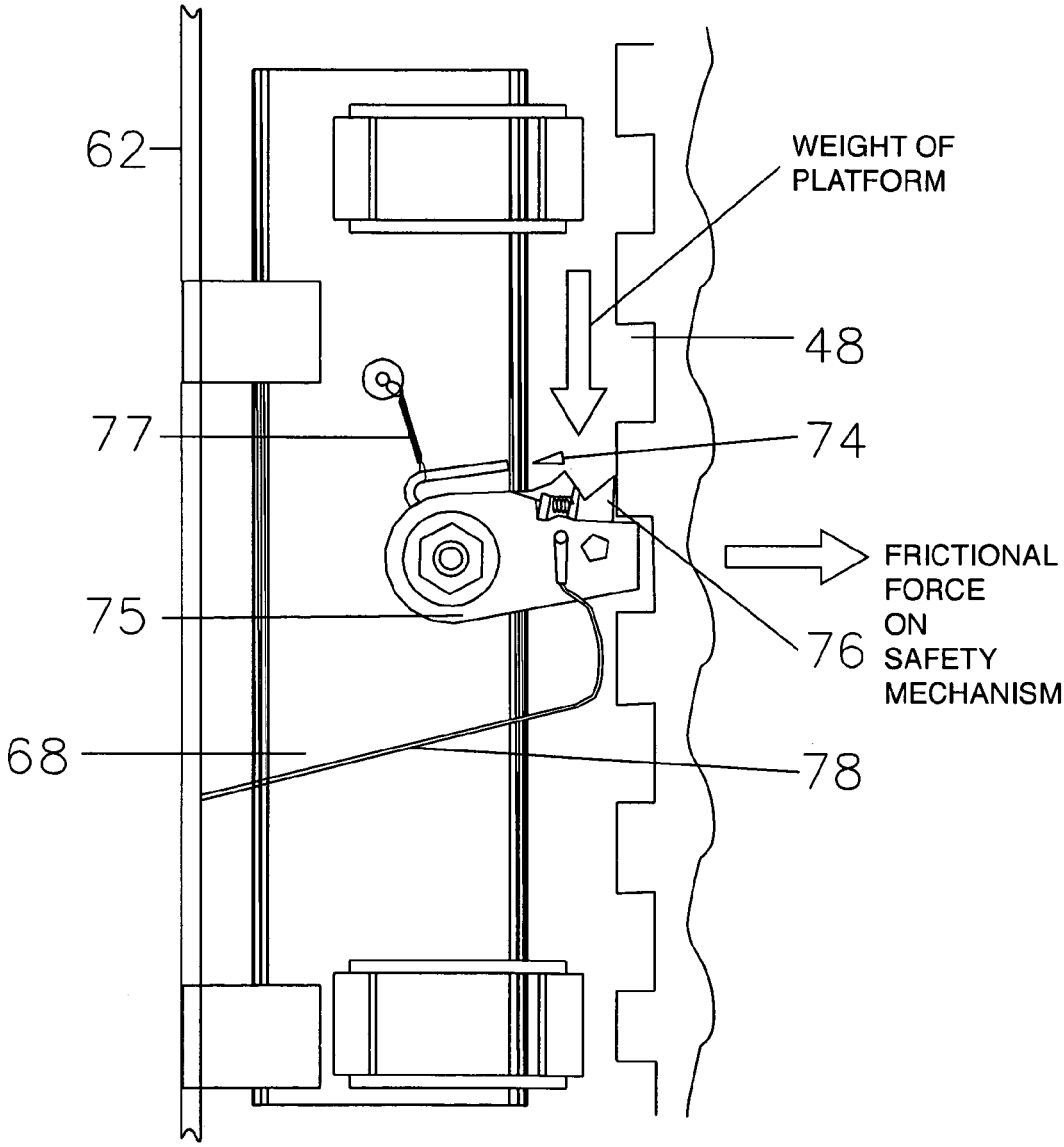
FIG. 12 is a schematic view of the safety latch of FIG. 1 oriented to engage the support member.

The storage platform assembly 20 further includes a safety mechanism 74 for preventing accidental lowering of the platform portion 26 after the platform portion 26 has been raised into a desired storage position. The safety mechanism 74 is illustrated in detail in FIGS. 10 and 12. The safety mechanism 74 includes a latch member 75 pivotingly connected to the sleeve member 68 and disposed to pivotingly engage the toothed member 48 when the sleeve is positioned within the support member with the rail-engaging portions 72 interlockingly slideably engaging the rails 70 (as shown in FIG. 9B.) The latch member 75 includes an elongated tooth-engaging portion 76. A biasing member 77, such as a spring, extends between the latch member 75 and the sleeve 68 and is positioned to exert a biasing force on the tooth-engaging portion 76, urging the tooth-engaging portion 76 to pivot into the toothed member 48. The safety mechanism 74 further includes a flexible connector 78, such as a steel cable, connected thereto and extending to some convenient point on the assembly 20. The flexible connector 78 is positioned to exert a counter-biasing force on the tooth engaging portion, urging the tooth-engaging portion 76 to pivot away from the toothed member 48. Preferably, the latch member 75 is balanced such that once the counter-biasing force is exerted to pivot the tooth-engaging portion 76 away from the toothed member 48, the latch member 75 will remain disengaged from the toothed member 48 long enough for the platform portion 26 to be lowered to the ground. This may be achieved by selecting a damped biasing mechanism as biasing member 77, including a reengaging portion extending from the latch member 75 to pivot the tooth engaging portion 76 towards the toothed member 48 when the platform is traveling upwardly, or by any like means known to one of ordinary skill in the art.

Figure 11:
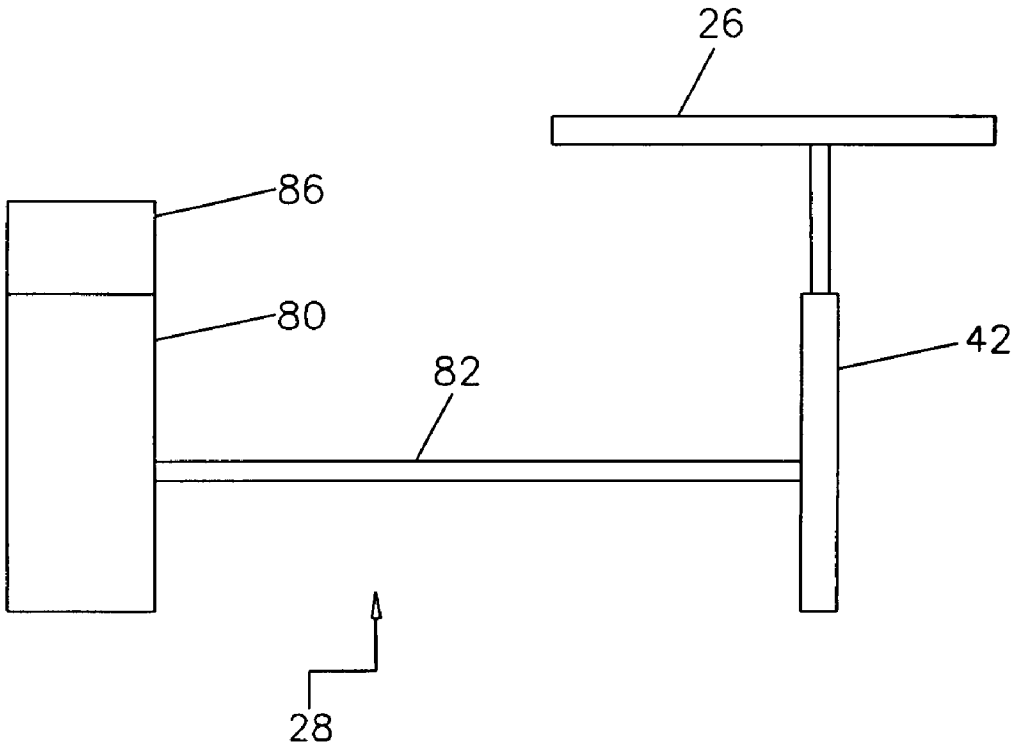
FIG. 11 is a schematic diagram illustrating the motion actuator system of the embodiment of FIG. 1.

FIG. 11 illustrates the lift actuator 28 in greater detail. The lift actuator 28 includes a power source 80 in communication with a power transmission conduit 82. The power transmission conduit 82 extends from the power source to the lifting member 42, to which it is operationally connected such that energization of the power source 80 transmits power through the power transmission conduit 82 to the lifting member 42, actuating the lifting member 42 to urge the platform 26 upwardly (or downwardly) along the elongated support member 24. The lift actuator 28 preferably includes a control assembly 86 operationally connected to the power source 80. More preferably, the control assembly 86 is adapted to be locked when not in use, such as by a secure code or a removable key, such that the probability of accidental movement of the platform portion 26 is minimized. Also preferably, the power transmission conduit 82 is adapted to be readily removed and reconnected from the power source 80 and/or the lifting member 42 to minimize accidental movement of the platform portion 26. Even more preferably, the power source is adapted to provide a predetermined maximum amount of lift power as a load safety precaution.

In the preferred embodiment, the motion actuator 28 is hydraulic, i.e. the power source 80 is a hydraulic pump and the conduit 82 is a hydraulic hose. The lifting member 42 is a hydraulic cylinder. The pump 80 is preferably internally configured, such as by a safety valve, to provide a predetermined maximum lifting pressure, such as 2000 pounds. Also preferably, the hose 82 may be readily connected/disconnected to the pump 80 and/or the cylinder 42 to establish/break a hydraulic communication link between the pump 80 and the cylinder 42 to prevent undesired lowering of the platform portion 26 by unauthorized persons, such as young children or thieves. In other embodiments, the motion actuator may be pneumatic, electromechanical, or the like.

In operation, the portable elevatable storage platform assembly 20 may be used to store an item (such as a lawn tractor) in a storage area (such as a garage) as follows. The freestanding vertical storage platform assembly 20 is first positioned as desired in the storage area. Preferably, the assembly 20 is positioned against the far wall of the storage area, such that no storage space is wasted behind the assembly 20. Next, the platform portion 26 is positioned adjacent the ground, i.e. adjacent the base portion 22. The lawn tractor is loaded onto the platform, and then the platform is elevated to a desired distance from the base portion 22. Once raised, the platform portion 26 is (preferably automatically) locked in place to prevent movement of the platform portion 26 toward the base portion 22 (i.e., accidental lowering of the platform portion 26). (See FIG. 12) When it is desired to retrieve the stored item from storage, the platform portion 26 is first unlocked. In the preferred embodiment detailed above, this is done by first actuating the motion actuator 28 to slightly raise the platform portion 26, and then pulling the flexible member 78 to release the safety mechanism 74 by pivoting the tooth-engaging portion 76 away from the toothed member 48. In this embodiment, it is necessary to slightly raise the platform portion 26 before disengaging the safety mechanism 74, since the weight of the platform portion 26 and any loaded items at least partially rests upon the safety latch 74, resulting in sufficiently great frictional forces generated between the safety latch 75 and the toothed member 48 that it is essentially impossible to release the safety latch 75 by pulling on the flexible member 78 without first raising the platform portion 26 to relieve the frictional forces.

Once the safety mechanism 74 is disengaged, the motion actuator 28 may be engaged to lower the platform portion 26 substantially to the ground, or at least far enough to facilitate unloading of the platform portion 26. It is preferred that if the platform portion 26 is to be left in a raised position for any length of time, the motion actuator 28 be disabled (such as by key control, removal of the conduit 82, or the like) to prevent accidental lowering of the platform portion 26.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nearly infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A storage device for off-floor storage, comprising:

a base for emplacement on a floor of a storage area;

a substantially vertical support member extending from the base and defining a deployment axis;

a platform movably connected to the vertical support member;

a lift actuator operationally connected to the platform; and a failsafe safety mechanism operationally connected to the lift platform;

wherein the lift actuator may be energized to move the platform into any one of a plurality of substantially parallel vertical positions oriented generally transversely to the deployment axis;

wherein the base frictionally engages the floor;

wherein the base is mechanically decoupled from the floor;

wherein movement of the platform to a sufficiently raised position enables positioning of the platform over a portion of an automobile;

wherein the platform includes a notch formed therethrough through which the substantially vertical support member extends;

wherein actuation of the failsafe safety mechanism engages the support member to prevent further downward motion of the platform;

wherein once the failsafe safety mechanism is engaged, the platform rests on the safety mechanism; and wherein the platform must be raised off of the safety mechanism prior to disengagement of the safety mechanism.

2. The device of claim 1 wherein the platform is substantially solid.

3. The device of claim 1 wherein the lift actuator further comprises a hydraulic cylinder connected between the platform and the base, a hydraulic pump, and a hydraulic hose extending between the hydraulic pump and the hydraulic cylinder, wherein the hydraulic pump is in hydraulic communication with the hydraulic cylinder.

4. The device of claim 3 wherein the hydraulic pump is adapted to provide a predetermined maximum lifting force to the platform.

5. The device of claim 4 wherein the predetermined maximum lifting force is about 2000 pounds.

6. The device of claim 1 wherein the platform is substantially rectangular and wherein the platform extends substantially directly over the base.

7. The device of claim 1 wherein platform includes a notch formed therethrough through which the substantially vertical support member extends.

8. The device of claim 1 wherein the platform further comprises a fence portion connected thereto, wherein the fence portion extends vertically away from the platform to prevent cargo from dislodging therefrom.

9. A vertically elevatable storage platform assembly, comprising:

a freestanding base assembly for positioning on a support surface;

a life assembly operationally connected to the base assembly and further comprising:

a substantially vertical column having a toothed portion and connected to the freestanding base assembly;

a lift actuator operationally connected to the substantially vertical column;

a platform operatively connected to said life assembly, said lift actuator operable to move said platform between a first position substantially adjacent said freestanding base assembly and a second position vertically displaced from said first position; and an automatic safety interlock engagable with the support column to prevent accidental lowering of the platform;

wherein the platform includes a notch formed therethrough through which the substantially vertical column extends;

wherein the freestanding base further includes a plurality of leveling feet extending therefrom to adjustably engage the support surface;

wherein movement of the platform to the second position allows sufficient open space below the platform for the positioning of a portion of an automobile therebeneath;

wherein the automatic safety interlock automatically engages the toothed portion to prevent the lowering of the platform;

wherein the platform must be raised from the engaged safety interlock before the safety interlock may be disengaged.

10. The assembly of claim 9 wherein the platform is substantially solid.

11. The assembly of claim 9 wherein the leveling feet may be adjusted to level the freestanding base relative to the horizontal.

12. The assembly of claim 9 wherein the lift actuator further comprises a hydraulic cylinder connected between the platform and the base assembly, a hydraulic pump, and a hydraulic hose extending between the hydraulic pump and the hydraulic cylinder, wherein the hydraulic pump is in hydraulic communication with the hydraulic cylinder.

13. The assembly of claim 9 wherein the base assembly is a substantially rectangular framework and wherein the platform is a substantially rectangular member extending substantially directly over the base.

14. The assembly of claim 9 wherein the platform further comprises a cargo-restraining barrier extending therefrom.

15. The assembly of claim 14 wherein the barrier includes a flexible member connectable thereto.

16. The assembly of claim 14 wherein the barrier includes a fence extending vertically from the platform.

17. A storage device for off-floor storage, comprising:

a base for emplacement on a floor of a storage area;

a substantially vertical support member extending from the base and defining a deployment axis;

a platform movably connected to the vertical support member;

a lift actuator operationally connected to the platform; and a safety mechanism lockingly for preventing the accidental lowering of the platform and operationally connected to the lift actuator;

wherein the lift actuator may be energized to move the platform into any one of a plurality of substantially parallel vertical positions oriented generally transversely to the deployment axis;

wherein the base frictionally engages the floor;

wherein the base is freestanding on the floor;

wherein the platform includes a notch formed therethrough through which the substantially vertical support member extends;

wherein the safety mechanism automatically engages the support member to prevent downward travel of the platform;

wherein the safety mechanism is biased such that disengagement of the safety member prevents automatic reengagement of the safety mechanism for a sufficient period of time for the platform to travel to the floor; and wherein, once engaged, the platform must be at least partially raised to facilitate disengagement of the safety mechanism.

* * * * *